US006223384B1

(12) United States Patent
Kuhlen

(10) Patent No.: US 6,223,384 B1
(45) Date of Patent: May 1, 2001

(54) TROWEL WITH A HANDLE

(75) Inventor: Adolf Kuhlen, Remscheid (DE)

(73) Assignee: Kuhlen GmbH, Remscheid (DE)

( * ) Notice: Subject to any disclaimer, the term of this patent is extended or adjusted under 35 U.S.C. 154(b) by 0 days.

(21) Appl. No.: 09/231,858

(22) Filed: Jan. 14, 1999

(30) Foreign Application Priority Data

Jan. 20, 1998 (DE) ..... 298 00 879 U

(51) Int. Cl.[7] ..... B05C 17/10
(52) U.S. Cl. ..... 15/235.4; 15/143.1
(58) Field of Search ..... 15/235.4, 235.5, 15/235.6, 235.7, 235.8, 143.1; 16/110 R, 111 R; 425/458

(56) References Cited

U.S. PATENT DOCUMENTS

| | | | | |
|---|---|---|---|---|
| 696,066 | * | 3/1902 | Miller | 15/235.4 |
| 1,168,643 | * | 1/1916 | Johnson | 15/235.4 |
| 2,076,836 | * | 4/1937 | Goldblatt | 15/235.4 |
| 2,578,163 | * | 12/1951 | Whalen | 15/235.4 |
| 3,045,271 | * | 7/1962 | Cinotti | 15/235.7 |
| 4,817,231 | * | 4/1989 | Ocwieja | 15/235.4 |
| 4,884,312 | * | 12/1989 | Clark | 15/143.1 |
| 5,097,909 | * | 3/1992 | Jauhal et al. | 15/235.4 |
| 5,446,941 | | 9/1995 | Kelsay . | |
| 5,491,896 | * | 2/1996 | Stolzer et al. | 15/236.01 |
| 5,522,111 | | 6/1996 | Kelsay et al. . | |
| 5,632,569 | * | 5/1997 | Szmansky | 15/235.4 |
| 5,956,799 | * | 9/1999 | Panaccione et al. | 15/236.01 |

FOREIGN PATENT DOCUMENTS

| | | |
|---|---|---|
| 1875730 | 5/1963 | (DE) . |
| 3540565 | 6/1987 | (DE) . |

* cited by examiner

*Primary Examiner*—Terrence R. Till
(74) *Attorney, Agent, or Firm*—Martin A. Farber

(57) ABSTRACT

A trowel with a handle, having a blade (15) and a mount (2), provided thereon, for the handle (1), the mount (2) is fastened on the blade (15) by a fastening section (4), has a spacer section (3) and is inserted in an opening (6) of the handle (1) by way of an insertion section (5). For more straightforward assembly and production, it is provided that the insertion section (5) is inserted in a radial opening (6) of the handle (1), with the result that a securing pin (8) which is introduced axially into the handle is used to secure the insertion section (5) against being drawn out.

16 Claims, 6 Drawing Sheets

TROWEL WITH A HANDLE

FIELD AND BACKGROUND OF THE INVENTION

The invention relates to a trowel with a handle, having a blade and a mount, provided thereon, for the handle, wherein the mount is fastened on the blade by a fastening section, has a spacer section and is inserted in an opening of the handle by an insertion section.

A trowel of this type is known in the prior art. Merely by way of example, reference is made to U.S. Pat. Nos. 5,446,941 or 5,522,111. In these documents, the mount for the handle is fastened on the blade by a fastening section. The fastening section continues into a spacer section. In the case of the smoothing trowel presented in U.S. Pat. No. 5,522,111, the fastening section is configured as a rib which extends essentially over the entire length of the blade. The spacer section projects approximately at right angles from the fastening section. Fastened at the end of the spacer section is the handle, which extends approximately parallel to the rib. The handle is connected to the mount by means of an insertion section. In the case of the prior art, the insertion section is designed as a tang which projects through the handle, in the longitudinal direction of the latter, and is fastened to the handle by an end-side nut. The insertion section projects approximately at right angles from the spacer section.

Furthermore, Utility Model 18 75 730 discloses a smoothing trowel in which a tang passes through a handle. A similar smoothing trowel is known from DE 35 40 565 A1. A tang passes through the handle in this document too. Positioned in the end region of the handle is a plug-on neck with laterally projecting wings for thumb support.

The object of the invention is to provide a trowel of the introductory-mentioned type in order, while maintaining the use advantages achieved by the measures of the prior art, to ensure more straightforward assembly and production.

SUMMARY OF THE INVENTION

According to the invention the insertion section (5) is inserted in a radial opening (6) of the handle (1) provides a trowel in the case of which the handle is connected to the trowel without the conventional tang running in the longitudinal direction of the handle. One aspect of the invention is the fact that the insertion section is inserted in a radial opening of the handle. Rather than the handle being connected to the mount by being pushed onto a tang in its longitudinal direction, the handle is now inserted radially onto the insertion section of the mount. A securing pin which is inserted axially into the handle can be used to secure the insertion section against being drawn out. It is advantageous if the insertion section tapers in its insertion direction. If the insertion section is to fit in the radial opening in a correspondingly shaped manner, the tapering brings about a wedging action, which provides for play-free mounting of the handle on the insertion section. The handle is advantageously injection molded from a plastic. The core of the injection mold which fits in the radial opening may in this case be in the form of the insertion section. The slight, production-induced shrinkage of the plastic material then ensures a tight fit of the insertion section in the insertion opening (radial opening). In a further advantageous configuration, the insertion section is an essentially rectilinear extension of the spacer section. This variant is advantageous, in particular, in the case of smoothing trowels. The insertion section may be rounded at its end. This is advantageous from an injection-molding point of view. It also, however, brings advantages in the production of the insertion section, which is stub-like in relation to the conventional, long tangs and extends into the handle, beyond the center of the latter. The insertion section may be in the form of a pyramid. The securing pin, by means of which the insertion section is secured in the correspondingly shaped radial opening, may be designed as a countersunk-head screw which is screwed into the end of the handle and passes through an opening of the insertion section. In this case, the thread of the countersunk-head screw cuts into the solid volume of the handle. In a preferred configuration, the handle body, which consists of a rigid plastic, is coated by a flexible-plastic sheathing. It is advantageous if that end side of the handle into which the countersunk-head screw is screwed consists of rigid plastic material.

Moreover, the invention comprises a handle for a trowel or the like. In the region of its end side, the handle has a radial opening for the insertion of an insertion section of a fastening section or the like. The handle preferably comprises a rigid-plastic core, which preferably forms a hollow body. This hollow body may be made up of two half-open core parts. When they have been fitted together, the two half-open core parts form a parting joint. This parting joint is covered over by the flexible-plastic sheathing. In order for it to be possible for the two core parts to be fitted together, the borders of the core parts are of relatively narrow configuration, with the result that an overlapping zone is formed. In this overlapping zone, the two core parts latch with one another. Arranged on the outside of the core part are webs, of which the height corresponds to the thickness of the flexible-plastic sheathing. The fitted-together rigid-plastic core can thus be positioned, and centered, in an injection mold with a gap around it, the webs being supported on the mold cavity. The flexible plastic is then injected into said gap, with the result that the end surfaces of the webs, in alignment with the flexible-plastic sheathing, are exposed to the outside.

BRIEF DESCRIPTION OF THE DRAWINGS

With the above and other objects and other advantages in view, the present invention will become more clearly understood in connection with the detailed description of preferred embodiments, when considered with the accompanying drawings of which

DETAILED DESCRIPTION OF THE PREFERRED EMBODIMENTS

Figure 1:
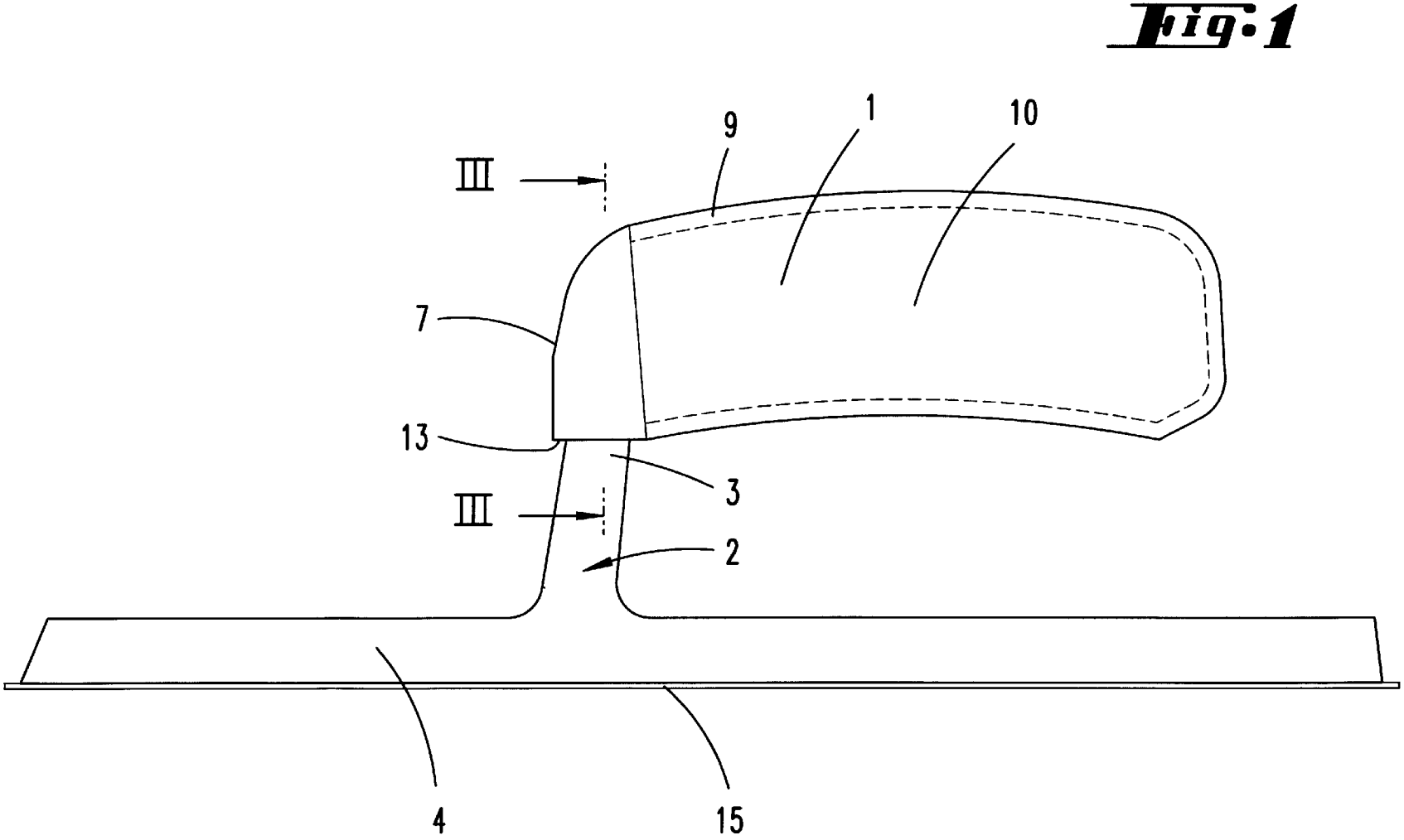
FIG. 1 shows the side view of a trowel according to the invention in the form of a smoothing trowel.
Figure 2:
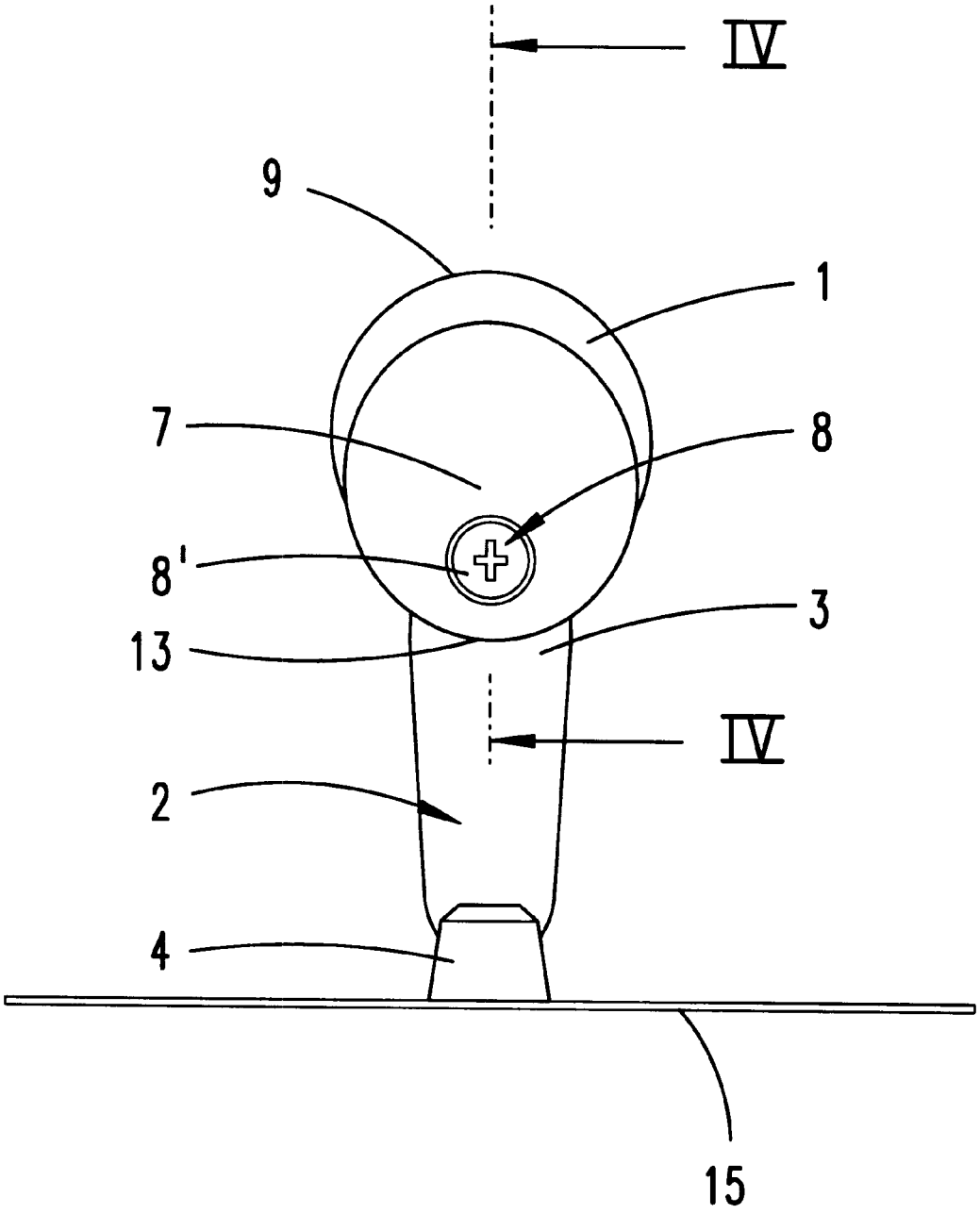
FIG. 2 shows a front view of the trowel according to FIG. 1.
Figure 3:
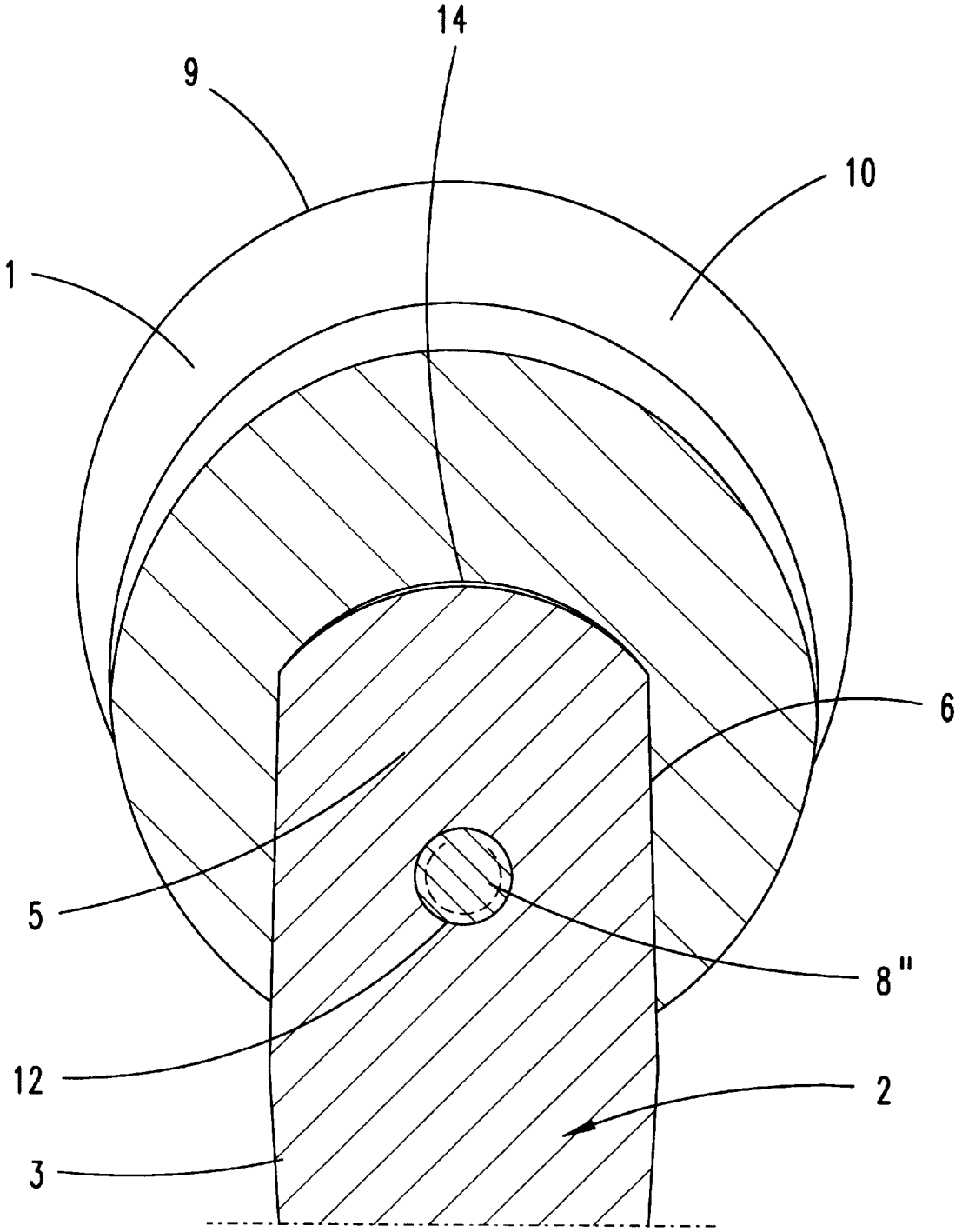
FIG. 3 shows a section along line III—III in FIG. 1.
Figure 4:
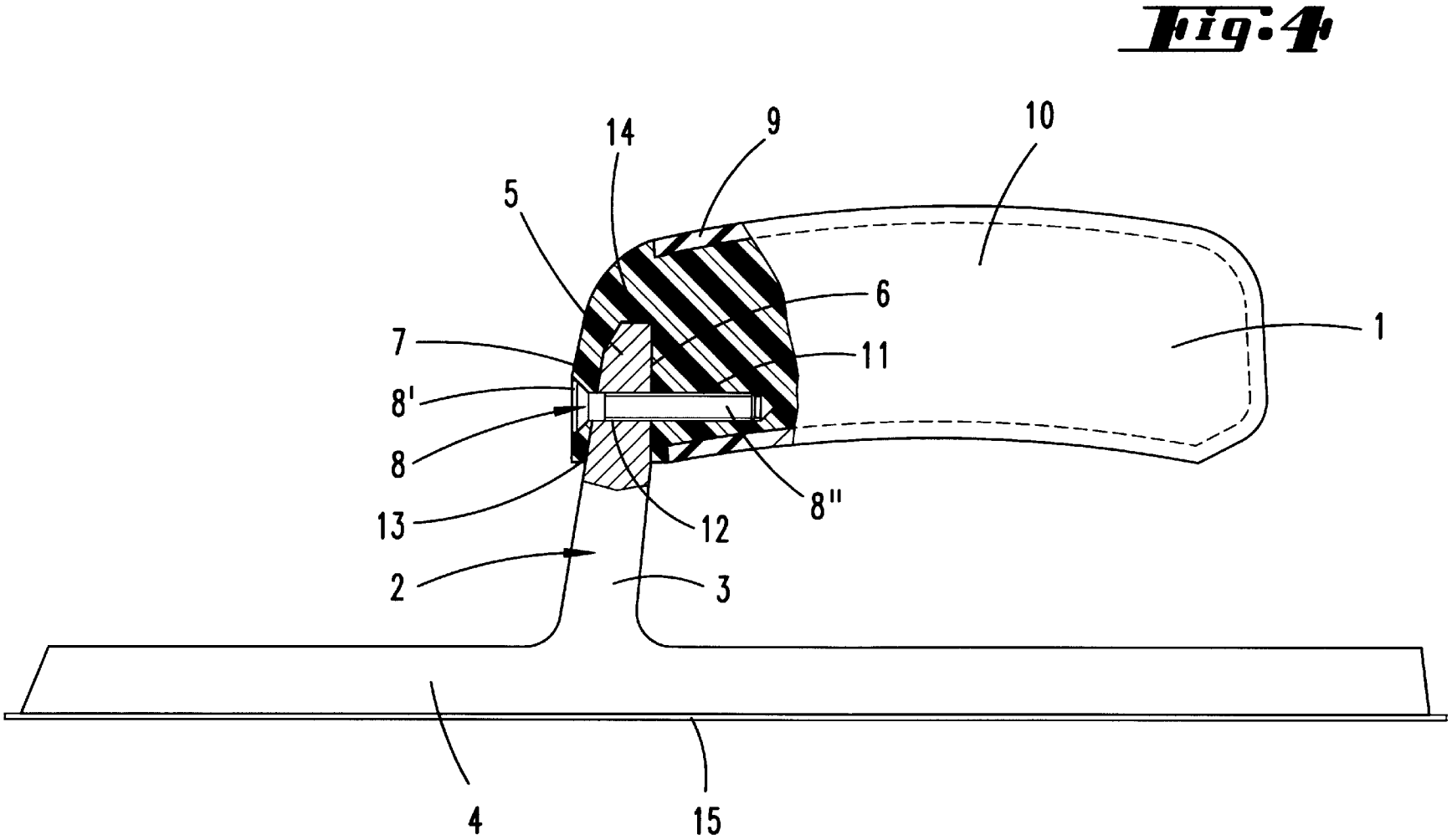
FIG. 4 shows a partly broken-away view according to FIG. 1 along section line IV—IV in FIG. 2.

Approximately in the center of the fastening section 4, a spacer section 3 projects approximately at right angles from the rib. The spacer section 3 continues approximately rectilinearly into an insertion section 5. The fastening section 4, spacer section 3 and insertion section 5, in an integral arrangement, form the mount 2.

The insertion section 5 is essentially in the form of a truncated pyramid. It tapers in the insertion direction and has a rounded end edge 14. The insertion section 5, which is of approximately the same width and depth as the spacer section 3, is inserted in a correspondingly shaped insertion opening 6 of the handle 1.

The handle essentially comprises a plastic body which is essentially in the form of a circular cylinder and has a solid rigid core 10 which is enclosed by a flexible-plastic sheathing 9. In the region of the insertion opening 6, the rigid core 10 projects as far as the handle surface. The insertion opening 6 extends beyond the imaginary longitudinal center axis of the handle and is spaced apart from the end side 7 of the handle 1 by a distance measuring a few millimeters. As a result, a small step 13, behind which the spacer section 3 extends, is formed.

The insertion section 5 has a through-passage opening 12. A countersunk-head screw 8 which is screwed into the end side 7 engages through the through-passage opening 12 by way of its shank and is screwed into a tightening opening 11 of the rigid-plastic core 10 of the handle 1 by way of its threaded section 8". The countersunk head 8' of the screw 8 is screwed flush into the surface of the end side 7.

It is considered to be advantageous that the handle can be fitted by a pressing movement in the direction of the surface normal of the blade 15. It is also considered to be advantageous that a tang running approximately parallel to the rib 4 can be done away with completely. Producing the handle by injection molding has proven advantageous. By virtue of the configuration of a mold in which the core which is inserted in the insertion opening 6 is of the same form as the insertion section 5, the shrinkage which occurs when the injection-molded plastic part is cooling down produces an adhering force for the insertion section 5, which is pressed under pressure into the insertion opening 6. Assembly can take place by way of a pneumatic pressure cylinder.

The blade 15 preferably consists of steel, and the mount preferably consists of aluminum.

In loading tests on the handle according to the invention, it has been found that the latter is considerably more resistant than a conventional handle, with tang, to radial loading on the free end of the handle. The brittleness of the tang is responsible for the fact that said tang breaks off after a certain number of loading displacements, whereas the handle according to the invention remains completely functional when this number of displacements has been exceeded, and resists a number of such loading displacements without being destroyed.

The resistance of the trowel according to the invention is not weakened either by the mount being produced as an aluminum casting.

Figure 6:
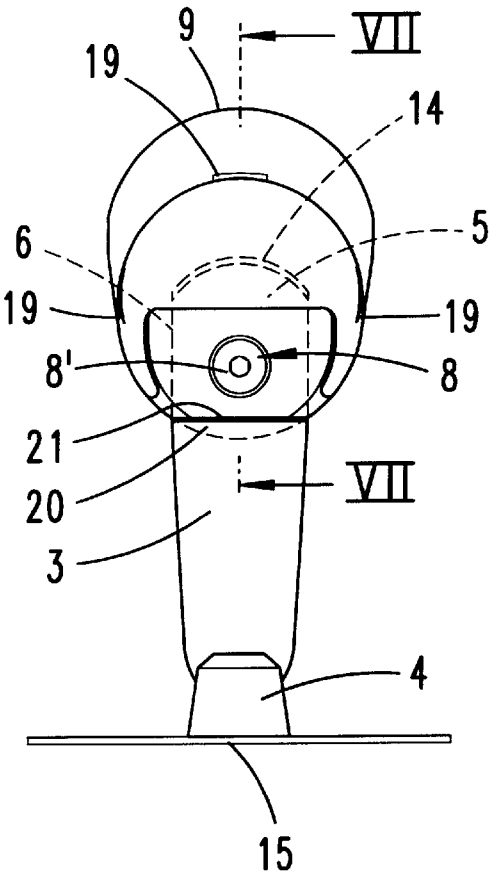
FIG. 6 shows a side view of the second exemplary embodiment.
Figure 5:
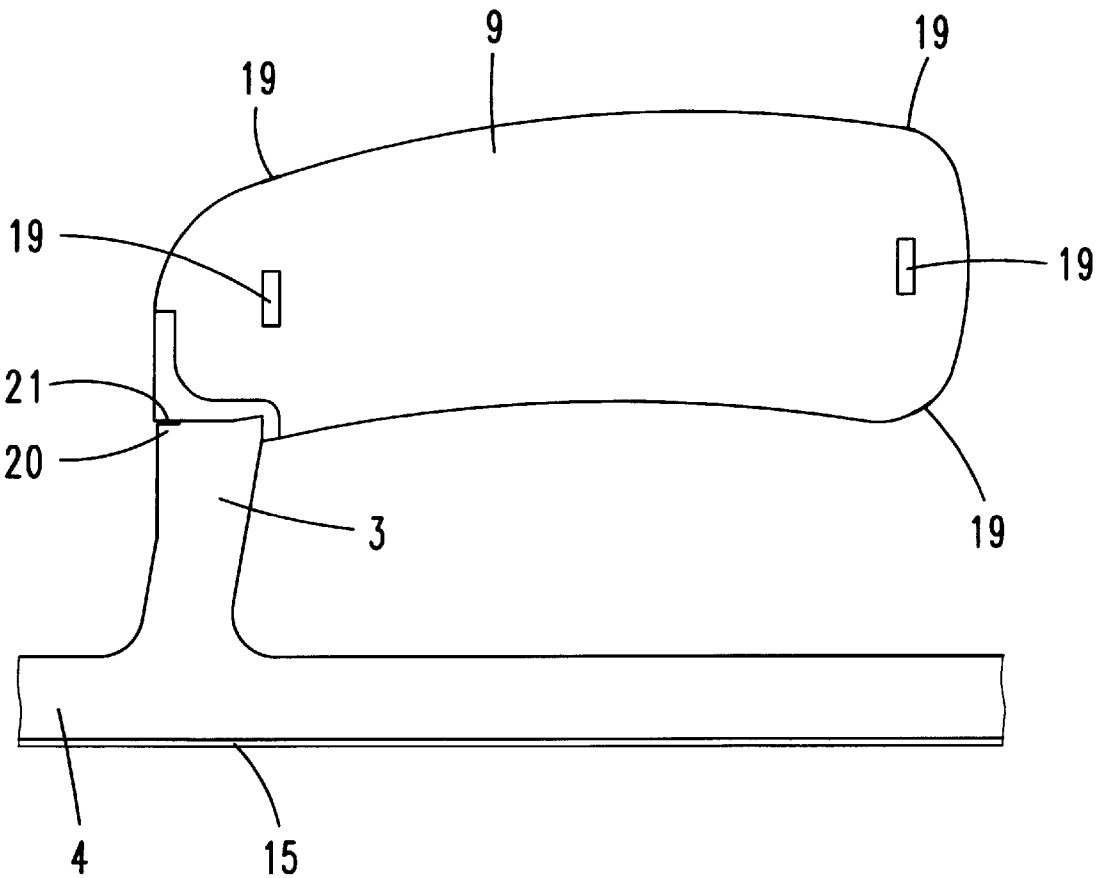
FIG. 5 shows the view of a second exemplary embodiment of the invention.
Figure 7:
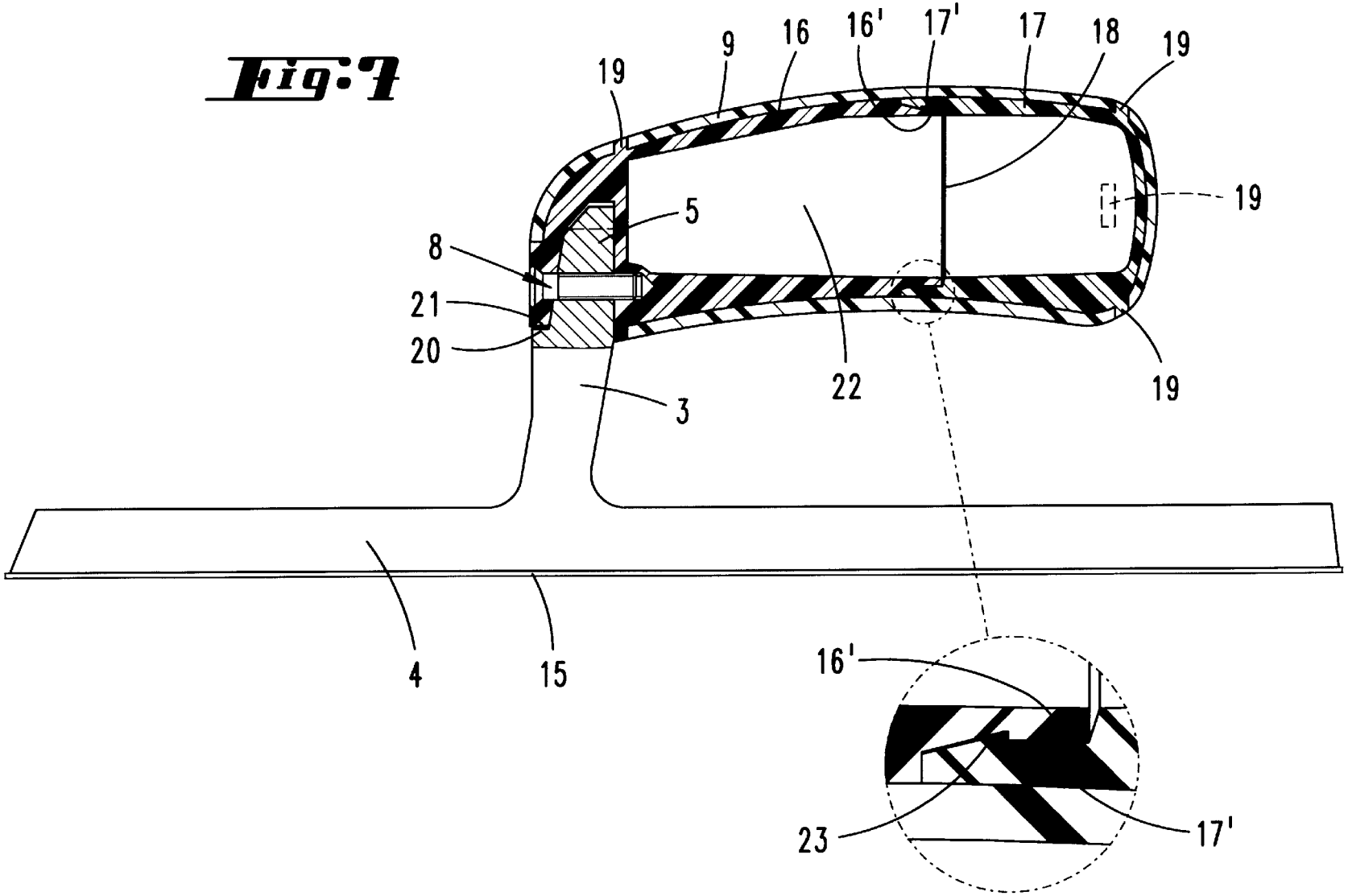
FIG. 7 shows a section along line VII—VII in FIG. 6.

The exemplary embodiment which is illustrated in FIGS. 5 to 7 differs from the previously described exemplary embodiment in that the spacer section 3 has a material thickening 20 beneath the end side 7, with the result that the spacer section 3 merges in an aligned manner into the end side 7. Provided between the material thickening 20 and the handle 1 is a gap 21, which is of a width of approximately 1 mm or less. This allows the handle to be forced tightly onto the insertion section 5. With the handle 1 being subjected radially to pressure in this way, the securing pin 8 can be pushed or screwed in. The gap 21 is produced if, as a result of decreasing radial pressure, the insertion section 5 springs out of the radial opening 6 to a slight extent.

The handle 1 comprises a rigid-plastic core 10 which, in turn, is made up of two half-open core parts 16, 17. The core parts 16, 17 are fitted one in the other such that they form a closed hollow 22. In order to facilitate the fitting-together operation, the opening borders 16', 17' of the core parts 16, 17 have a reduced wall thickness, such that the opening borders 16'17' are located one above the other and form an overlapping zone. The border sections 16', 17' form latching means 23, with the result that the two core parts 16, 17 can be preassembled and do not become disengaged from one another. It is also possible for the two core parts 16, 17 to be adhesively bonded to one another.

On the outside wall, the core parts 16, 17 have webs 19. The height of the webs 19 corresponds to the thickness of the flexible-plastic sheathing wall 9. The webs 19 serve as centering protrusions when the assembled rigid-plastic core is inserted into an injection mold in order to be encapsulated by flexible plastic. This encapsulation also keeps the two half-open core parts 16, 17 connected together. The joint 18 between the core parts 16, 17 is covered over by flexible plastic in this case. The flexible-plastic shrinkage which takes place after the encapsulation operation secures the two core parts 16, 17 together.

All the features disclosed are essential to the invention. The disclosure contents of the associated/attached priority documents (copy of the prior application) are hereby also included in full in the disclosure of the application, also for the purpose of adopting features of these documents in claims of the present application.

What is claimed is:

1. A trowel with a handle, having a blade (15) and a mount (2), provided thereon, for the handle (1), wherein the mount (2) is fastened on the blade (15) by a fastening section (4), has a spacer section (3) and is inserted in a radial opening (6) of the handle (1) by an insertion section (5), and a securing pin (8) is introduced axially into the handle so as to secure the insertion section (5) against being drawn out; and wherein the insertion section (5) tapers in an insertion direction.

2. A trowel with a handle, having a blade (15) and a mount (2), provided thereon, for the handle (1), wherein the mount (2) is fastened on the blade (15) by a fastening section (4), has a spacer section (3) and is inserted in a radial opening (6) of the handle (1) by an insertion section (5), wherein the insertion section (5) tapers in an insertion direction.

3. The trowel as claimed in claim 2, wherein said insertion section (5) fits in the radial opening (6) in a complementary shaped manner.

4. The trowel as claimed in claim 2, wherein said handle is a plastic injection molding part.

5. The trowel as claimed in claim 2, wherein said insertion section (5) is an essentially rectilinear extension of the spacer section (3).

6. The trowel as claimed in claim 2, wherein the trowel is a smoothing trowel, wherein said fastening section (4) is fastened on the blade, and the spacer section (3) projects approximately from a center of the fastening section (4).

7. The trowel according to claim 6, further comprising rivets fastening the fastening section on the blade.

8. A trowel with a handle, having a blade (15) and a mount (2), provided thereon, for the handle (1), wherein the mount (2) is fastened on the blade (15) by a fastening section (4), has a spacer section (3) and is inserted in a radial opening (6) of the handle (1) by an insertion section (5), wherein the insertion section (5) is in the form of a truncated pyramid.

9. The trowel as claimed in claim 8, wherein said truncated pyramid is rounded at an end thereof.

10. A trowel with a handle, having a blade (15) and a mount (2), provided thereon, for the handle (1), the handle having a rigid-plastic core, wherein the mount (2) is fastened on the blade (15) by a fastening section (4), has a spacer section (3) and is inserted in an opening (6) of the core by an insertion section (5), a screw (8) introduced axially into the rigid-plastic core secures the mount from being drawn out, wherein, said screw being inserted into an end-side opening of the core adjacent an end-side of the insertion section passes through an opening (12) of the insertion section and cuts into an opening (11) of the core adjacent an opposite end-side of the insertion section by a threaded section (8") of the screw.

11. The trowel as claimed in claim 10, wherein said screw is a countersunk-head screw.

12. A handle for a trowel, having a radial insertion opening (6) which is arranged in a region of an end side (7) of the handle, and an insertion section (5) of a fastening section (4) is insertable in said opening, wherein the radial insertion opening is provided in a rigid plastic core (10) which is at least partially sheathed by flexible plastic and has an axial opening into which a securing pin (8), which crosses over the radial opening (6), is insertable or screwable, wherein the handle (1) has said rigid plastic core and a flexible-plastic sheathing (9), the insertion opening (6) being associated with the core (10), wherein the rigid plastic core (10) comprises two half-open core parts (16, 17) which, fit together to form a parting joint (18) covered over by the flexible-plastic sheathing (9), forming a closed cavity (22).

13. The handle as claimed in claim 12, further comprising a latch, and wherein the two core parts (16, 17) latch by said latch (23), forming an overlapping zone (16', 17').

14. A handle for a trowel, having a radial insertion opening (6) which is arranged in a region of an end side (7) of the handle, and an insertion section (5) of a fastening section (4) is insertable in said opening, wherein the radial insertion opening is provided in a rigid plastic core (10) which is at least partially sheathed by flexible plastic and has an axial opening into which a securing pin (8), which crosses over at the radial opening (6), is insertable or screwable;

wherein the handle (1) has said rigid plastic core and a flexible-plastic sheathing (9), the insertion opening (6) being associated with the core (10), further comprising webs (19) which project outward from the rigid plastic core (10) and said webs have a height corresponding to the thickness of the flexible-plastic sheathing.

15. A handle for a trowel, having a radial insertion opening (6) which is arranged in a region of an end side (7) of the handle, and an insertion section (5) of a fastening section (4) is insertable in said opening, wherein the radial insertion opening is provided in a rigid plastic core (10) which is at least partially sheathed by flexible plastic and has an axial opening into which a securing pin (8), which crosses over the radial opening (6), is insertable or screwable, wherein joined to said insertion section is a spacer section (3) having a material thickening (20), wherein its surface merges aligned with the end side (7) of the handle with formation of a gap (21).

16. A trowel with a handle, having a blade (15) and a mount (2), provided thereon, for the handle (1) wherein the mount (2) is fastened on the blade (15) by a fastening section (4), has a spacer section (3) and is inserted in a radial opening (6) of the handle (1) by an insertion section (5), wherein the insertion section (5) is inserted in said radial opening (6) of the handle (1), a securing pin (8) introduced axially into the handle so as to secure the insertion section (5) against being drawn out; and wherein the insertion section (5) tapers in an insertion direction, wherein said handle (1) has a rigid-plastic core and a flexible-plastic sheathing (9), the rigid-plastic core (10) comprising two half-open core parts (16,17), said core parts fit together to form a parting joint (18) covered over by the flexible-plastic sheathing (9), forming a closed cavity (22).

* * * * *